US008261722B2

(12) United States Patent
Froehlich et al.

(10) Patent No.: US 8,261,722 B2
(45) Date of Patent: Sep. 11, 2012

(54) DELIVERY UNIT

(75) Inventors: Walter Froehlich, Frankfurt am Main (DE); Günter Rauchhaus, Raunheim (DE); Thomas Sippel, Fulda (DE)

(73) Assignee: Continental Automotive GmbH, Hannover (DE)

( * ) Notice: Subject to any disclaimer, the term of this patent is extended or adjusted under 35 U.S.C. 154(b) by 345 days.

(21) Appl. No.: 12/525,862

(22) PCT Filed: Feb. 1, 2008

(86) PCT No.: PCT/EP2008/051251

§ 371 (c)(1),
(2), (4) Date: Sep. 1, 2009

(87) PCT Pub. No.: WO2008/098848

PCT Pub. Date: Aug. 21, 2008

(65) Prior Publication Data

US 2010/0126473 A1 May 27, 2010

(30) Foreign Application Priority Data

Feb. 14, 2007 (DE) ..... 10 2007 007 918

(51) Int. Cl.
*F02M 37/10* (2006.01)

(52) U.S. Cl. ..... 123/509; 123/514; 123/516; 137/572

(58) Field of Classification Search ..... 123/497, 123/509, 514, 516; 137/571–576
See application file for complete search history.

(56) References Cited

U.S. PATENT DOCUMENTS

| | | | | |
|---|---|---|---|---|
| 5,649,514 | A | 7/1997 | Okada | |
| 5,769,061 | A | 6/1998 | Nagata | |
| 6,145,536 | A | 11/2000 | Gerhard et al. | |
| 6,293,256 | B1 | 9/2001 | Kleppner et al. | |
| 6,298,540 | B1 | 10/2001 | Benjey et al. | |
| 6,457,945 | B2 * | 10/2002 | Kleppner et al. | 417/84 |
| 6,672,288 | B1 * | 1/2004 | Schelhas et al. | 123/509 |
| 7,007,677 | B2 * | 3/2006 | Toki et al. | 123/509 |
| 7,117,856 | B2 * | 10/2006 | Honda et al. | 123/514 |
| 7,757,671 | B2 * | 7/2010 | Danjo et al. | 123/509 |
| 2004/0020839 | A1 | 2/2004 | Kato | |
| 2006/0021603 | A1 * | 2/2006 | Nagata | 123/514 |
| 2006/0231079 | A1 | 10/2006 | Paluszewski | |
| 2007/0227510 | A1 | 10/2007 | Mason | |

FOREIGN PATENT DOCUMENTS

| | | | |
|---|---|---|---|
| EP | 0 798 458 | | 10/1997 |
| EP | 0 798 458 | A1 | 10/1997 |
| EP | 798458 | A1 * | 10/1997 |
| EP | 1 388 664 | | 2/2004 |
| EP | 1 388 664 | A2 | 2/2004 |
| EP | 1388664 | A2 * | 2/2004 |
| JP | 2002-506501 | A | 2/2002 |
| JP | 2004-124936 | A | 4/2004 |
| JP | 2004-510090 | A | 4/2004 |
| RU | 2 191 282 | C2 | 10/2002 |

* cited by examiner

*Primary Examiner* — Erick Solis
(74) *Attorney, Agent, or Firm* — Cozen O'Connor

(57) ABSTRACT

A delivery unit for delivering fuel from a fuel reservoir to an internal combustion engine of a motor vehicle. The delivery unit includes a fuel pump arranged in a swirl pot, a fuel filter arranged downstream of the fuel pump, and a valve arranged in the swirl pot. The valve is arranged downstream of the fuel filter and in a zone of the swirl pot that is continuously filled with fuel.

9 Claims, 2 Drawing Sheets

DELIVERY UNIT

PRIORITY CLAIM

This is a U.S. national stage of application No. PCT/EP008/0512151, filed on 1 Feb. 2008, which claims Priority to the German Application No.: 10 2007 007 918.6, filed: 14 Feb. 2007 the contents of both being incorporated herein by reference.

BACKGROUND OF THE INVENTION

Field of the Invention

The invention is a delivery unit for delivering fuel from a fuel container to an internal combustion engine, having a fuel pump arranged in a splash pot, a fuel filter arranged downstream of the fuel pump, and a pressure control valve arranged in the splash pot.

Delivery units of this type are known. It is known to arrange pressure control valves in the splash pot after the fuel filter. Valves of this type maintain the pressure in the inflow line when the fuel pump is switched off, in order, in the case of a subsequent start, to deliver fuel at nominal pressure in as short a time as possible via the inflow line to the internal combustion engine of the motor vehicle.

SUMMARY OF THE INVENTION

A problem occurs when hot fuel cools when the motor vehicle is at a standstill and the fuel volume reduces as it cools. This leads to a vacuum in the lines and assemblies which route fuel. The valve opens as a result of the vacuum and air penetrates into regions which route fuel. As a result, the time period until the fuel is delivered at nominal pressure is extended during restarting of the internal combustion engine.

The present invention is based on providing a delivery unit which can be produced with low expenditure.

According to one embodiment of the invention, a valve is arranged downstream of the fuel filter and in a region of the splash pot, which is continuously filled with fuel.

As a consequence of the valve continuously dipping into the fuel, fuel is sucked in when the valve is opened, due to a vacuum in the lines which route fuel. The penetration of air into the lines which route fuel is therefore prevented. During restarting of the internal combustion engine, no disruptive air cushion therefore has to be filled up, as a result of which the delivery unit delivers fuel at nominal pressure to the internal combustion engine in a relatively short time.

The valve in the bottom of the splash pot ensures that the valve is always in a region that is continuously filled with fuel.

Since the inflow that emanates from the fuel filter often begins in the upper region of the splash pot due to the arrangement of the fuel filter the valve is preferably arranged in the bottom region of the splash pot. The inflow line extends in the region of the valve in the bottom region of the splash pot. According to another embodiment, a relocation of the inflow line is avoided by a connecting line which branches off from the inflow line arranged in the inflow line or in the outlet stub of the fuel filter, and by said connecting line being connected to the valve.

According to one advantageous refinement, a reliable relocation of the connecting line in the splash pot is achieved by the connecting line being mounted in a holding device arranged on the filter housing. The holding device is produced particularly simply by it being injection molded in one piece on the filter housing.

The stability of the connecting line is advantageously increased by the connecting line being a rigid line.

The assembly of the delivery unit is simplified when the connecting line is configured integrally with the valve housing. Here, in particular, injection molding has proven to be a particularly inexpensive process with great design options. The valve can be a pressure control valve here.

BRIEF DESCRIPTION OF THE DRAWINGS

The invention will be explained in greater detail using one exemplary embodiment. In the drawing.

DETAILED DESCRIPTION OF THE DRAWINGS

Figure 1:
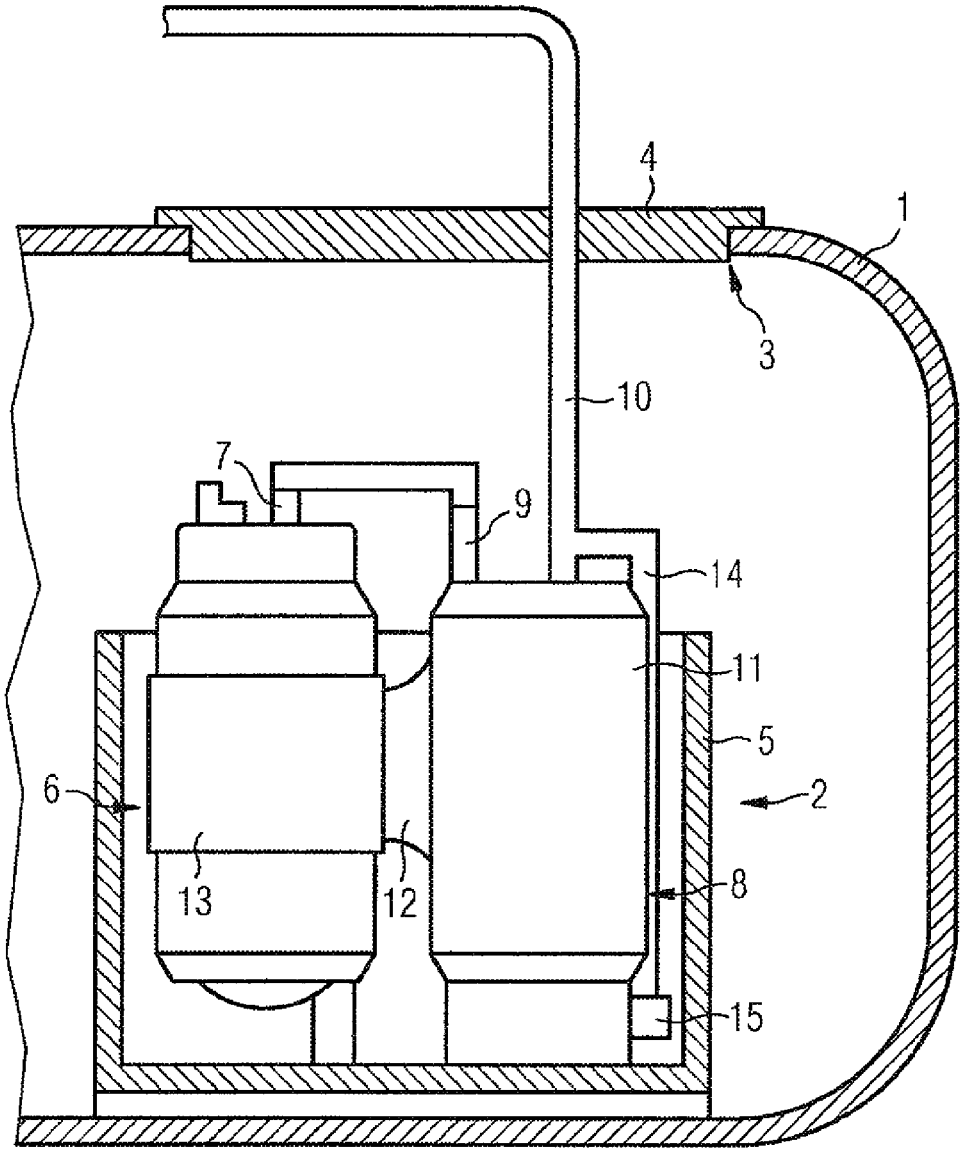
FIG. 1 is a diagrammatic illustration of the delivery unit in a fuel container.
Figure 2:
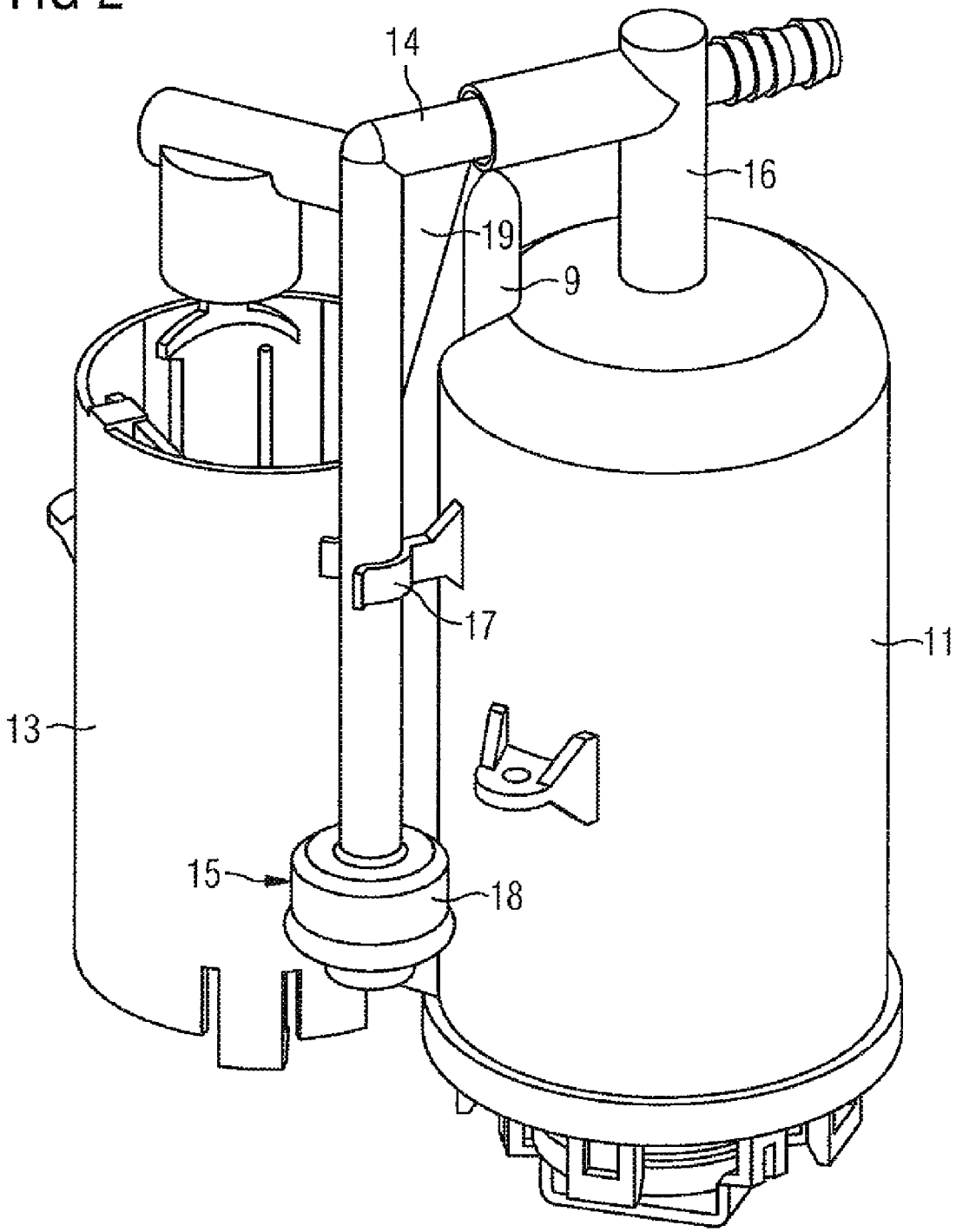
FIG. 2 is a perspective view of the filter housing with the valve.

FIG. 1 shows a fuel container 1 of a motor vehicle (not shown in further detail) having a delivery unit 2 which is inserted through an opening 3 in the fuel container 1. After assembly has been carried out, the opening 3 is closed with a flange 4. The delivery unit 2 comprises a splash pot 5 which is prestressed against the bottom of the fuel container 1. A fuel pump 6 which sucks fuel out of the splash pot 5 and delivers it via an outlet stub 7 is arranged in the splash pot 5. Furthermore, a fuel filter 8 is arranged in the splash pot 5, which fuel filter 8 is arranged downstream of the fuel pump 6 as viewed fluidically, with the result that the fuel which is delivered by the fuel pump 6 passes via an inlet stub 9 into the fuel filter 8. The filtered fuel subsequently passes via an inflow line 10 through the flange 4 to an internal combustion engine (not shown) of the motor vehicle. The housing 11 of the fuel filter 8 has a web 12 which is injection molded integrally and merges into a pump holder 13. The fuel pump 6 is mounted in the pump holder 13. The filter housing 11 is composed of polyoxymethylene. A connecting line 14 branches off from the inflow line 10 and extends to a valve 15 in the bottom region of the splash pot 5. FIG. 2 shows the filter housing 11 with the outlet stub 16 and the inlet stab 9. The fuel filter is not shown in this view. The pump holder 13 is formed integrally on the filter housing 11 by means of injection molding, with the result that both components form one unit. The outlet stub 16 is configured as a T-piece, to which the inflow line 10 (not shown) and the connecting line 14 are connected. The connecting line 14 is configured as a rigid line which is mounted additionally in a holding device 17 to increase the stability and to counter undesired movements. The holding device 17 is preferably injection molded on the filter housing 11. The lower end of the connecting line 14 is adjoined by the valve 15. The housing 18 of the valve 15 is configured in one piece with the connecting line 14. The L-shaped connecting line 14 is additionally reinforced in the angled region by an integrally molded web 19.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A delivery unit configured to deliver fuel from a fuel container, the delivery unit comprising:

a splash pot;

a fuel pump configured to be arranged in the splash pot;

a fuel filter arranged downstream of the fuel pump, the fuel filter having a filter housing and an outlet stub having a first port configured to deliver the fuel from the fuel container;

a connecting line that branches off from the outlet stub;

a holding device arranged on the filter housing, the holding device configured to retain the connecting line; and a valve arranged in the splash pot downstream of the fuel filter coupled to an end of the connecting line in a region of the splash pot that is continuously filled with fuel.

2. The delivery unit as claimed in claim 1, wherein the valve is arranged in a bottom region of the splash pot.

3. The delivery unit as claimed in claim 2, wherein the outlet stub exits the filter substantially vertically and the connecting line branches off from the outlet stub substantially perpendicular to the outlet stub.

4. The delivery unit as claimed in claim 3, wherein the connecting line is a rigid line.

5. The delivery unit as claimed in claim 3, wherein the connecting line is formed integrally with the valve housing.

6. The delivery unit as claimed in claim 1, wherein the valve is a pressure control valve.

7. The delivery unit as claimed in claim 3, wherein the connecting line is formed with the valve housing by injection molding.

8. The delivery unit as claimed in claim 3, wherein the valve opens in response to a vacuum in the outlet stub or the connecting line, whereby the arrangement of the valve in the region of the splash pot that is continuously filled with fuel permits only fuel to enter the connecting line when the valve is open and thereby prevents air from entering the connecting line and the outlet stub.

9. The delivery unit as claimed in claim 3, wherein the connecting line is L-shaped and the outlet stub is T-shaped, a first end of a horizontal portion of the T-shaped outlet stub coupled to the L-shaped connecting line and an other end of the horizontal portion of the T-shaped outlet stub configured to deliver the fuel from the fuel container.

* * * * *